United States Patent [19]

Cohn

[11] 4,136,770

[45] Jan. 30, 1979

[54] SAFETY MATCHBOOK AND MATCHES

[76] Inventor: Charles C. Cohn, 123 S. New Hampshire Ave., Atlantic City, N.J. 08401

[21] Appl. No.: 819,758

[22] Filed: Jul. 28, 1977

[51] Int. Cl.[2] ..... A24F 27/00

[52] U.S. Cl. ..... 206/106; 44/42; 149/4

[58] Field of Search ..... 44/42–47; 206/104, 106; 149/4, 75

[56] References Cited

U.S. PATENT DOCUMENTS

| | | | |
|---|---|---|---|
| 2,558,201 | 6/1951 | Weston | 44/42 X |
| 3,838,989 | 10/1974 | Cohn | 44/46 X |

*Primary Examiner*—Steven E. Lipman
*Attorney, Agent, or Firm*—George A. Smith, Jr.

[57] ABSTRACT

A match which is difficult for young children to ignite utilizes a protective coating on the tip of a match head which prevents ignition of the sulfur and potassium chlorate-containing mixture when an attempt is made to strike the match in the usual manner with its stem substantially perpendicular to the friction surface of the matchbook. The protective coating requires a special manipulation of the match whereby its stem is disposed at an angle preferably less than about forty degrees with respect to the friction surface so that the unprotected side of the match head can rub against the friction and ignite the match.

6 Claims, 11 Drawing Figures

SAFETY MATCHBOOK AND MATCHES

BRIEF SUMMARY OF THE INVENTION

This invention relates to matches and matchbooks, and particularly to an improvement in safety matches whereby the safety of the matches is increased by making the matches more difficult for young children to ignite.

As is well-known, a large number of accidental fires are caused each year by children, under the age of about five years, playing with safety matches. The principal object of the invention is to achieve a substantial reduction in the number of occurrences of such accidental fires. It is also an object of the invention to achieve this reduction in the number of accidental fires by means of a matchbook which is practical from a manufacturing standpoint, i.e. a matchbook which can be easily manufactured at a cost not greatly exceeding the cost of manufacture of conventional matchbooks. It is also an object of the invention to make a matchbook which can be used easily by an adult, but which substantially reduces the likelihood of successful match ignition by a young child.

The foregoing objects are accomplished in accordance with the invention by a match head construction which requires a special manipulation in order for the match to be ignited. The match comprises a substantially straight elongated stem, and a head located at one end thereof, the head comprising a bulbous mass of flammable material adapted to ignite when rubbed against the friction surface of the matchbook. The match head is provided with a coating of a material incapable of igniting when rubbed against the friction surface. This coating is located at the tip of the match head, and prevents ignition of the match when rubbed against the friction surface with the stem substantially perpendicular to said surface. Preferably, the protective coating covers the bulbous mass of flammable material over an area of the tip such that the bulbous mass is prevented from coming into direct contact with a planar friction surface except when the angle between the stem and the friction surface is less than approximately forty degrees.

Young children, in attempting to strike a match, tend to hold the match in a perpendicular, or nearly perpendicular relationship to the matchbook friction. When an attempt is made to strike the match in this relationship to the friction surface, the protective coating on the tip prevents it from igniting. An adult, however, will learn, by instructions printed on the matchbook itself, or otherwise, to hold the stem in a way such that the side of the match head is brought into contact with the friction surface during striking of the match.

Desirably, the protective coating is formed with a roughened or pointed, hard outer surface so that attempts by children to strike the match result in removal of material from the matchbook friction surface thereby providing an added measure of safety.

In accordance with another embodiment of the invention a protective coating covering at least the tip of the match head, or covering the entire match head, if desired, is made of a thickness such that it is rubbed off only by multiple attempts to strike the match. Young children tend to give up their efforts after about three attempts at striking a match. Hence, if the thickness of the coating is such that at least four attempts are required, the match can be ignited successfully by an adult, but will not be ignited by most young children.

DETAILED DESCRIPTION

Figure 1:
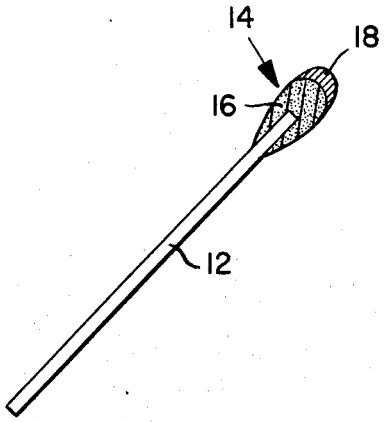
FIG. 1 is a vertical section taken through a safety match made in accordance with the invention.
Figure 2:
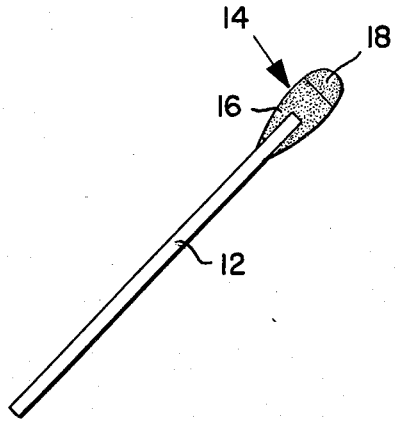
FIG. 2 is an elevational view of the safety match of FIG. 1.

FIGS. 1 and 2 show a safety match comprising a substantially straight, elongated stem 12 of conventional matchboard, preferably treated chemically to minimize glow after the match has been extinguished. A head 14 is provided at one end of stem 12. The head comprises two parts. Part 16 of the head, which contacts the stem, is a bulbous, generally tear-drop shaped mass of flammable material, which may be the conventional match head composition, which includes a mixture of potassium chlorate and sulfur as active ingredients, and also includes fillers, abrasives, glue and dye. The mixture of potassium chlorate and sulfur ignites when rubbed against a phosphorus-containing friction surface on a matchbook. Bulbous mass 16 flares after ignition for a short interval, and stem 12, which is usually coated with paraffin throughout part of its length, burns thereafter until the match is extinguished.

In accordance with the invention, a coating 18 is provided at the tip of the match head, i.e. on the surface of the match head opposite the stem. Coating 18 can be one of, or a mixture of, any number of available materials which are incapable of igniting when rubbed against the particular friction surface which is provided on the matchbook. Where the friction surface is a phosphorus-containing surface, then the material or materials of coating 18 are chosen so as not to react with the phosphorus-containing surface to produce ignition. A good protective coating material is sodium silicate. For example, coating 18 can consist of a small quantity of type "O" sodium silicate applied as a concentrated solution and thereafter allowed to dry. Type "O" silicate is furnished by Philadelphia Quartz Company as a liquid comprising, by weight, 29.5% $SiO_2$, 61.3% $Na_2O$ and 9.2% $H_2O$.

Numerous alternative coating materials can be used. For example, excellent results can be achieved using alumina gel or powdered silica dispersed in an adhesive binder of sodium silicate or a similar adhesive. Glues such as Elmer's "Glue-All" by Borden, Inc. may also be used, as may acrylic floor finishes such as "Future", available from Johnson's Wax Co., and vinyl floor finishes such as "Mirasheen", available from Armstrong Cork Co. Rosins such as Sylvaros No. 80, Sylvaros RX and Sylvatac No. 95, available from Sylvachem Corporation of Jacksonville, Florida may also be used with excellent results. It is possible to apply these materials in various concentrations, so long as a coating is formed which protects the flammable material of the match head, and prevents it from coming into contact with the matchbook friction surface. The concentration of "Mirasheen" is such that two coats are required for best results. Each of the other materials, however, can be applied in a single coat.

Various filler materials can be used to improve the abrasion resistance of the protective coating. For example, the following mixtures, containing fillers in "O" type sodium silicate diluted to 70% by volume in water, produce coatings which perform satisfactorily:

1. A paste made from synthetic silica in sodium silicate, using 167 grams of Syloid 244 from Davison Chemical Company for every liter of diluted "O" type silicate.
2. A paste made from hydrated alumina and sodium silicate, using 167 grams of Alcoa Hydrated Alumina No. C31 for every liter of diluted "O" type silicate.
3. A slurry made from 167 grams of pumice for every liter of diluted "O" type silicate.
4. A slurry made from iron powder and sodium silicate, using 167 grams of Iron Powder "C" from Atlantic Powdered Metals, Inc. of New York, N.Y., for every liter of diluted "O" type silicate.
5. A paste made from wood flour and sodium silicate, using 83 grams of Wood Flour No. B610 from Wilmer Wood Products Company of Norway, Me. for every liter of diluted "O" type silicate.
6. A slurry comprising 167 grams of ordinary New Jersey beach sand for every liter of diluted "O" type silicate.
7. A mixture of wood cellulose and sodium silicate comprising 83 grams of "Solka-Floc" wood cellulose from Brown Company, Berlin, N. H., for every liter of diluted "O" type silicate.
8. A mixture comprising 167 grams of "Minusil", a silicon product from Pennsylvania Glass Sand Corporation, Gateway Center, Pa., for every liter of diluted "O" type silicate.

The proportions of ingredients in the foregoing examples, of course, may be varied widely, it being necessary only to use a sufficient quantity of silicate to produce a paste or slurry suitable for application to the match heads, in a sufficient concentration to provide a suitable binder.

It is also possible to utilize the inactive ingredients of a conventional tip composition, such as a mixture of filler, abrasive, glue, and dye, eliminating the active ingredients, potassium chlorate and sulfur, or at least eliminating the potassium chlorate.

Figure 3:
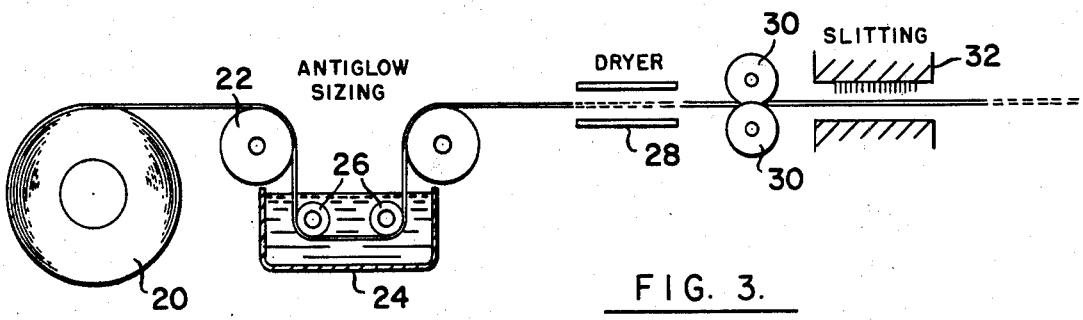
FIGS. 3 and 4 constitute a schematic diagram illustrating a process for manufacturing matches in accordance with the invention.
Figure 4:
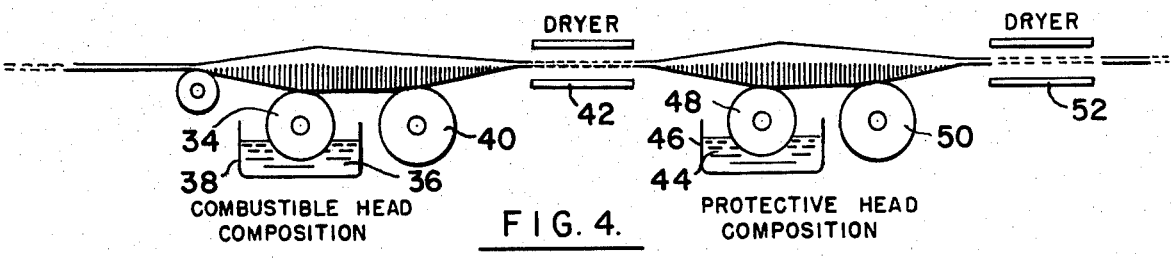

A process for producing matches in accordance with the invention is diagrammatically illustrated in FIGS. 3 and 4, the left-hand side of FIG. 4 being a continuation of the right-hand side of FIG. 3. The steps are, in themselves, conventional, and are therefore not shown in great detail.

Matchboard is fed from supply roll 20 over a guide roll 22 into a tank 24 for antiglow treatment, rollers 26 being provided in order to insure immersion of the matchboard.

Following the impregnation of the matchboard antiglow material, the board is passed through a dryer 28, and, assuming that the matchboard is wider than required for the desired length of the matches being produced, it is slit longitudinally by rotary knives 30 into narrow strips corresponding in width to the length of a match stem plus the strip which unites the individual match stems.

The next step in the procedure involves transverse slitting to form the individual match stems. Slitting is carried out by a die 32 operating in conventional fashion to separate the match stems proper by providing cuts extending from an edge of the strip inwardly to the common carrying strip. Referring now to FIG. 4, the strip which is initially horizontal is twisted by suitable rollers (not shown) to present the head ends of the separated match stems downwardly for application of the combustible head composition by means of a roller 34. The head composition 36 in tank 38 is carried by the rotating roller upwardly and thereby applied to the downwardly projecting head ends of the stems. A uniform thickness of match head composition is maintained on the surface of roller 34. Excess match head composition on the end of each stem is wiped off uniformly by a wiping roller 40. The strip passes through a dryer 42, which applies heat to evaporate moisture from the match heads.

Following this drying step, the protective head composition 44 in tank 46 is applied to the tips of the heads by application roller 48, excess composition being removed by wiping roller 50. A third dryer 52 effects drying of the protective coating. As the strip emerges from dryer 52, it is automatically cut into combs which are then assembled to produce matchbooks.

Figure 5:
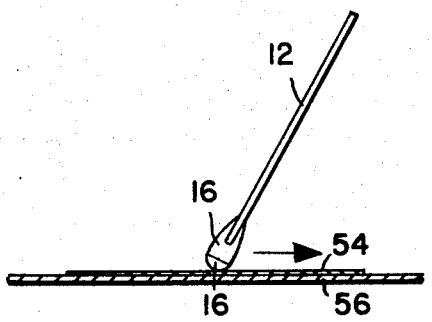
FIG. 5 is a section taken perpendicularly through a matchbook cover, and illustrating the operation of the protective coating in accordance with the invention.

The process represented by FIGS. 4 and 5 can be used for the application of any of the above-mentioned protective compositions. However, it is also possible to modify the process slightly by applying a binder, such as sodium silicate, in liquid form to the match head, and thereafter contact the match head, while wet, with filler material, such as synthetic silica, or hydrated alumina. When the process is thus modified, a lower concentration of silicate can be used.

In FIG. 5, the match of FIG. 1 is shown being moved in the direction of the arrow along a friction surface 54 disposed on a matchbook cover 56. Stem 12 of the match is very nearly perpendicular to the plane of friction surface 54, i.e. the match stem and friction surface are in the relationship in which they will normally be when a young child is attempting to strike the match. It will be seen in FIG. 5 that protective coating 18 is in contact with friction surface 54, preventing ignition of the active part 16 of the match head.

Figure 6:
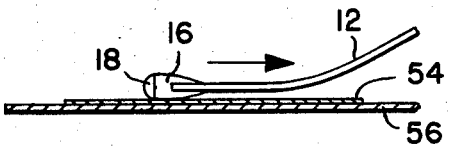
FIG. 6 is a section taken perpendicularly through a matchbook cover, and showing how a match made in accordance with the invention can be ignited by a special manipulation.

In order to ignite the match, the side of the match head is rubbed along friction surface 54, as illustrated in FIG. 6. The match stem 12 is nearly parallel to friction surface 54 so that part 16 of the match head comes into contact with surface 54, causing ignition of the match head when match stem 12 is pulled in the direction of the arrow.

Figure 7:
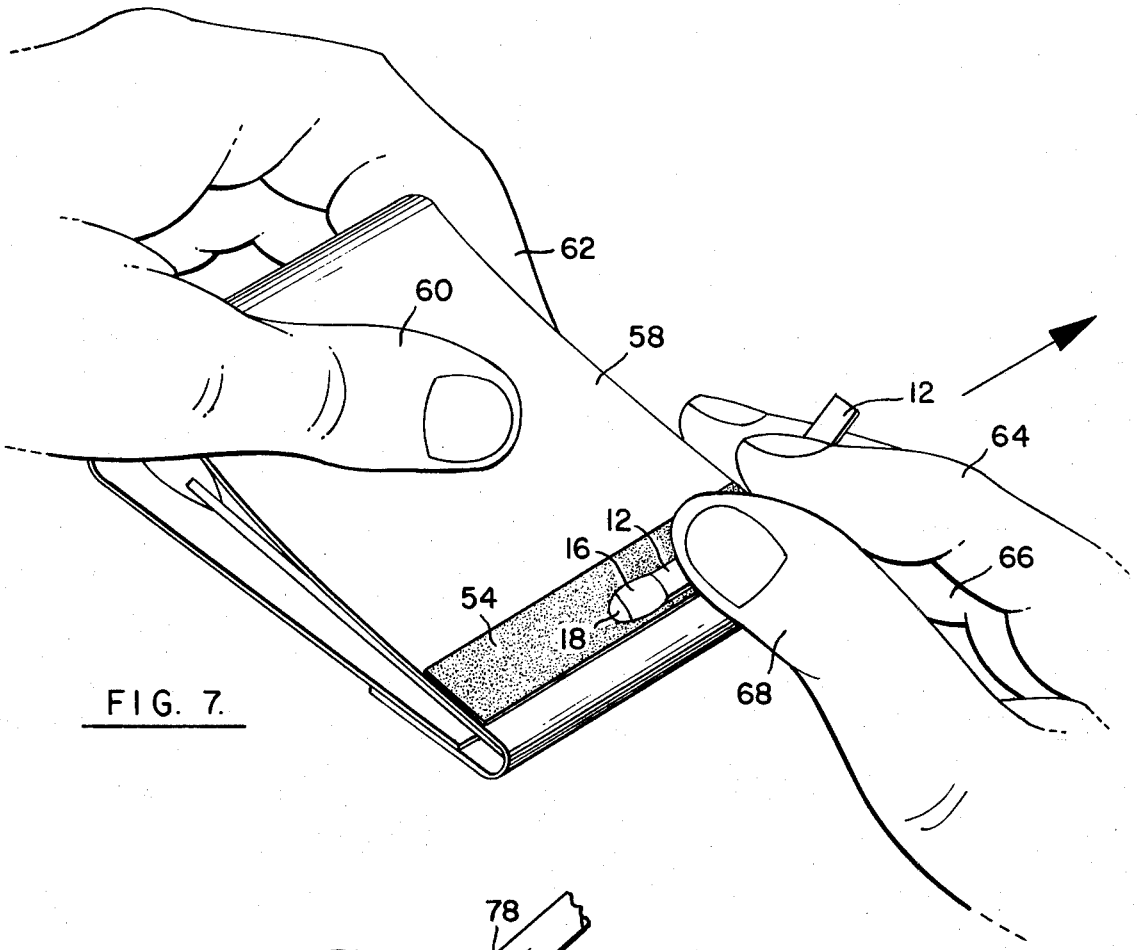
FIG. 7 is a perspective view of a match and matchbook in accordance with the invention, showing more fully a manner of manipulating the match for successful ignition.

One preferred manner of manipulating the match is illustrated in FIG. 7, wherein a matchbook 58 is held between the thumb 60 and the forefinger 62 of the left hand, while the match stem 12 is held between the first and second fingers 64 and 66 of the right hand, with thumb 68 of the right hand pushing downwardly against match stem 12, as shown, to maintain firm contact between part 16 of the match head and friction surface 54. The match is pulled along the friction surface in the direction of the arrow, and the match ignites, whereupon the thumb is rapidly moved upwardly away from the burning match head to prevent injury. This method of igniting the matches in accordance with the invention is highly satisfactory, and is easy for an adult to master. However, it cannot be accomplished by a young child, and the chances of a young child successfully igniting a match of the kind exemplified in FIGS. 1 and 2 is very low.

Figure 8:
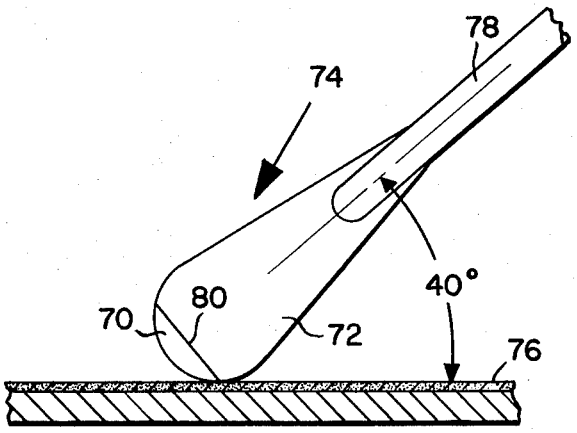
FIG. 8 is a section taken perpendicularly through a matchbook cover, illustrating in detail the relationship of the bulbous mass of flammable match head material, and a protective coating thereon.

The extent to which the protective coating covers the match head determines the critical angular relationship between the match stem and the friction surface, i.e. the angle above which ignition cannot be effected. In FIG. 8, the protective coating 70 on part 72 of match head 74 covers a portion of part 72 such that part 72 comes into contact with friction surface 76 when the angle between stem 78 and surface 76 is less than forty degrees, whereas part 72 of the match head is protected by coating 70 when the angle between the stem and the friction surface is greater than forty degrees. In the case of the match shown in FIG. 8, the critical angle is therefore approximately forty degrees. It will be recognized that slight irregularities in the demarcation line 80 of the coating, and the possibility of abrading the thin part of the coating near the demarcation line make it necessary to define the critical angle in approximate terms. Approximately forty degrees is considered to be the highest practical critical angle, as it is possible for young children to ignite matches having substantially higher critical angles.

Figure 9:
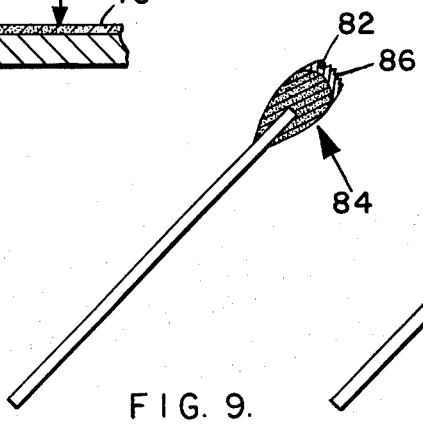

In the alternative embodiment illustrated in FIG. 9, a protective coating 82 on match head 84 is provided with a roughened, hard, outer surface 86, adapted to remove material from the matchbook friction surface. This roughened surface provides an added measure of safety, as multiple attempts by a child to strike a match result in the removal of a substantial amount of matchbook friction material making ignition of the match, and subsequent matches removed from the matchbook still less likely. Again, the match of FIG. 9 requires the manipulation depicted in FIG. 6 for successful ignition.

The roughened outer surface can be achieved in a number of ways. For example, an abrasive such as sand can be included in the coating, or applied in a separate step to a wet coating material immediately following application of the coating. Alternatively the wet coating can be caused to contact a rough or irregular drum surface while in a tacky condition just before it dries.

The material from which coating 82 is made can be one of a number of hard materials, such as epoxy resin known as "Epon Resin No. 1007", available from Shell Chemical Company.

Nylon resins can also be used to produce coatings with rough, hard outer surfaces corresponding to surface 86 in FIG. 9. For example "Nylatron GS" from Polymer Corp. of Reading, Pa. heated to about 350° F. or more produces a satisfactory rough coating when the melted resin on the match tip is brought into contact with a rough or irregular drum surface.

Figure 10:
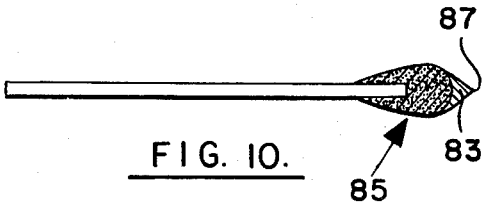
FIGS. 9, 10 and 11 are vertical sections taken through further alternative safety matches made in accordance with the invention.

In the alternative embodiment of FIG. 10, a protective coating 83 on match head 85 is provided with a hard point 87 at its tip. This point performs substantially the same function as roughened outer surface 86 in FIG. 9, that is it removes material from the matchbook friction surface as repeated attempts are made by a child to strike the match.

Protective coating 83 is typically made from Epon Resin No. 1007, which, when applied at a temperature between about 250° F. and 290° F., forms a thin thread upon withdrawal of the match head from contact with the molten resin. The thread dries immediately, and leaves a hard point 87 on the tip of the match head which is effective to remove friction material. When Epon Resin No. 1007 is applied at a temperature above about 300° F., a smooth coating is formed, which, while effective to prevent ignition, does not scratch the friction surface. Nylon resins such as Nylatron GS, and numerous other hard resins can be used to form the protective coating of FIG. 10.

The embodiments of FIG. 1 is considered to prevent ignition successfully when the coating is such as to require at least three unsuccessful striking attempts at angles above the critical angle of 40° before ignition can be achieved. The coatings in the embodiments of FIGS. 9 and 10 likewise have a thickness such that the flammable material is exposed only after at least three striking attempts at angles above 40°. Normally, of course, the thickness of the protective coating in these embodiments will be much greater than necessary to achieve these results.

Figure 11:
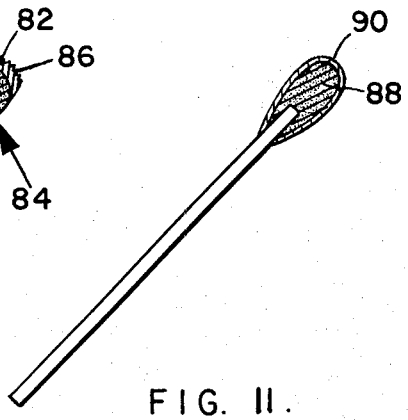

Another embodiment of the invention illustrated in FIG. 11 makes use of a relatively thin protective coating, and does not depend upon the angular relationship between the match stem and the matchbook friction surface for its operation. Bulbous mass 88 of flammable match head material is coated in its entirety by a thin coating 90 of protective material, having a thickness such that it is worn away by the matchbook friction surface after a selected number of striking attempts. Following about three unsuccessful attempts at striking a match, most young children abandon their efforts. By choosing a suitable thickness for the protective coating 90, a requirement for any desired number of multiple attempts at striking can be built into the match. For example, a coating of "O" type sodium silicate, applied in a ninety-one percent dilution (91% "O" silicate by volume in water), and having a thickness of about 0.0006 inch requires about three striking attempts before the match head will ignite successfully. Where Epon Resin No. 1007 is used, the thickness should be about 0.0003 inch in order for the match to require about three striking attempts. A coating of Elmer's Glue-All glue should have a thickness of about 0.001 inch for similar results. Of course, any desired number of striking attempts can be required by choosing a suitable coating thickness.

The match of FIG. 11 can be modified so that coating 90 covers only part of bulbous mass 88, in which event the match takes on some of the desirable characteristics of the matches of FIGS. 1 and 2.

The coatings used in any of the embodiments of the invention can be either flammable, as in the case of the various rosins, or non-flammable as in the case of sodium silicate. Silicate has a tendency to diminish the flare magnitude of a struck match, and may be desired in that it thereby provides an added measure of safety. On the other hand, protective coatings which are in themselves flammable are preferred where it is desired to maintain or increase the flare magnitude.

A wide variety of suitable coating materials in addition to those specifically set forth herein will be apparent to persons skilled in the art of match manufacture, and are considered to be within the scope of this invention. Numerous modifications in the materials specifically described herein, and in the particular match head and matchbook configurations, and in the manufacturing process can be made without departing from the scope of the invention as defined in the following claims.

I claim:

1. A match comprising a substantially straight elongated stem and a head located at one end thereof, said head comprising a bulbous mass of flammable material adapted to ignite when rubbed against a phosphorus-containing friction surface, and characterized by means providing a coating of material incapable of igniting when rubbed against a phosphorus-containing friction surface, said coating being located at the tip of said head, and preventing ignition of the match when rubbed against a phosphorus-containing friction surface with the stem substantially perpendicular to said surface.

2. A match according to claim 1 in which said coating covers said bulbous mass of flammable material over an area of its tip such that said bulbous mass is prevented from coming into direct contact with a planar friction surface except when the angle between the stem and the friction surface is less than approximately forty degrees.

3. A matchbook having a friction surface and containing a plurality of matches, each match comprising a substantially straight elongated stem and a head located at one end thereof, said head comprising a bulbous mass of flammable material adapted to ignite when rubbed against said friction surface, and characterized by means providing a coating of material incapable of igniting when rubbed against a said friction surface, said coating being located at the tip of said head, and preventing ignition of the match when rubbed against said friction surface with the stem substantially perpendicular to said surface.

4. A matchbook according to claim 3 in which said coating covers said bulbous mass of flammable material over an area of its tip such that said bulbous mass is prevented from coming into direct contact with said friction surface except when the angle between the stem and the friction surface is less than approximately forty degrees.

5. A matchbook according to claim 3 in which said coating is provided with a roughened or pointed, hard, outer surface adapted to remove material from said friction surface, thereby rendering it less effective.

6. A matchbook having a friction surface and containing a plurality of matches, each match comprising a substantially straight, elongated stem and a head located at one end thereof, said head comprising a bulbous mass of flammable material adapted to ignite when rubbed against said friction surface, and characterized by means providing a coating on said head, said coating covering at least the tip of said head and consisting of a material incapable of igniting when rubbed against said friction surface, said coating being of a thickness such that it is capable of being rubbed off to expose said flammable material of the head only by multiple attempts to strike said match against said friction surface.

* * * * *